US007024911B2

(12) United States Patent
Delhumeau et al.

(10) Patent No.: US 7,024,911 B2
(45) Date of Patent: Apr. 11, 2006

(54) PLIERS FOR CRIMPING THIMBLES ON ELECTRIC CABLES

(75) Inventors: Frédéric Delhumeau, Chartres (FR); Laurent Merle, La Ferte-Bernard (FR)

(73) Assignee: FCI, Paris (FR)

( * ) Notice: Subject to any disclaimer, the term of this patent is extended or adjusted under 35 U.S.C. 154(b) by 73 days.

(21) Appl. No.: 10/466,155

(22) PCT Filed: Jan. 16, 2002

(86) PCT No.: PCT/FR02/00162

§ 371 (c)(1),
(2), (4) Date: Jan. 15, 2004

(87) PCT Pub. No.: WO02/056429

PCT Pub. Date: Jul. 18, 2002

(65) Prior Publication Data

US 2004/0107760 A1 Jun. 10, 2004

(30) Foreign Application Priority Data

Jan. 16, 2001 (FR) ..... 01 00543

(51) Int. Cl.
*B21D 7/06* (2006.01)
*H01R 43/042* (2006.01)

(52) U.S. Cl. ..... 72/409.12; 72/409.16; 29/751; 81/367

(58) Field of Classification Search ..... 72/409.12, 72/409.16, 409.01; 29/751; 81/383, 367, 81/376, 378, 377, 384
See application file for complete search history.

(56) References Cited

U.S. PATENT DOCUMENTS

| | | | | |
|---|---|---|---|---|
| 763,227 | A * | 6/1904 | Walden | 81/367 |
| 2,672,778 | A * | 3/1954 | Jones | 81/368 |
| 2,814,222 | A * | 11/1957 | Sanders | 72/409.12 |
| 3,285,107 | A * | 11/1966 | Otto | 81/368 |
| 5,280,716 | A | 1/1994 | Ryan et al. | 72/410 |
| 6,109,088 | A | 8/2000 | Schrader et al. | 72/409.16 |

FOREIGN PATENT DOCUMENTS

DE 29623005 U1 12/1997

* cited by examiner

*Primary Examiner*—Daniel C. Crane
(74) *Attorney, Agent, or Firm*—Harrington & Smith, LLP

(57) ABSTRACT

The object of the invention is a pair of crimping pliers that comprises two arms (10) and (12), a fixed jaw and a movable jaw (34), which is articulated in regard to the two arms, and a hinge link interposed between the two arms.

This pair of pliers displays an angular point for forming an arch perpendicular to which is positioned the axis A3.

The present pair of pliers also has angular values and ratios of given lengths.

19 Claims, 3 Drawing Sheets

PLIERS FOR CRIMPING THIMBLES ON ELECTRIC CABLES

FIELD OF THE INVENTION

The present invention refers to a pair of crimping pliers, particularly for joining terminals to electric cables.

BACKGROUND OF THE INVENTION

The ends of electric cables have to include connecting elements, such as different types of terminals, in order to provide connections that depend on the applications.

Nevertheless, the mode of fixation always remains the same and consists in a deformation of one part of the terminal, forming a sleeve in which a cable is preferably inserted. This deformation action is called crimping.

The dimensions of the terminals vary according to the applications, but remain of necessity reduced, because the pair of pliers is operated by hand.

On the other hand, the applied force required for obtaining a good quality crimping of terminals on the cables remains important and an arrangement of levers is provided for these pliers for multiplying the manual force applied by the operator.

Known from U.S. Pat. No. 2,814,222 is a pair of crimping pliers that consists of a movable jaw and a multiplying lever.

This pair of pliers is simple, but the straight upper arm supports all of the stresses generated by the pressure of the movable jaw and the axis of rotation of the movable jaw is subjected to strong stresses. The crimping force is weakly multiplied.

In general, the tools of most recent prior art, particularly those described in the patent applications EP A 536,641 and EP A 536,652 comprise one arm, the end of which constitutes a fixed jaw, and a second arm, which operates, through a system of levers, a movable jaw that rotates around a pivot point that is an integral part of the first arm; when the operator squeezes the arms, this causes the movable jaw to come against the fixed jaw with a considerable squeezing force.

Any element interposed between the two jaws is subjected to the multiplied squeezing force obtained through the system of levers.

Moreover, known from U.S. Pat. No. 5,280,716 is a tool of the general type above, the two arms of which are joined to each other through an articulated hinge link on, on the one hand, a fixed axis that is an integral part of the arm bearing the fixed jaw and, on the other hand, a movable axis in an oblong opening placed in the other arm.

In a likewise known manner, the fixed jaw can be advantageously furnished with a turret that bears a number of indentations with a means of indexing this turret so that the desired indentation is maintained with respect to the movable jaw during the squeezing action.

Provided for in the known arrangements is a strong multiplication but a small opening of the jaws, which is not particularly adapted to the operator, especially when, prior to crimping, the terminals display a considerable diameter. On the other hand, it is appropriate to reduce the opening of the arms in order to make the manipulations more practical.

Moreover, it is necessary to avoid having the stresses at the level of the pivot point greater than the forces transmitted at the level of the jaws themselves, because, in this case, the efficiency is not optimal.

These pliers are made of light metallic materials, such as aluminum alloys, so as to attain a compromise between the different factors such as cost/quality/performance.

In order to improve these factors still further, it has been provided that such pliers be made of composite materials, such as fiber-loaded or fiber-reinforced polymer compositions.

Nevertheless, particularly in the case of a composite material realization, it is necessary to pursue several objectives and, with this aim in view, the present invention proposes a pair of crimping pliers that makes it possible, in particular:

- to reduce the stresses perpendicular to all pivot points to a value that is less than that of the force exerted at the level of the jaws;
- to produce a significant opening of the jaws for a given multiplied force, but a limited opening of the arms; and
- to retain a significant multiplied force so as to ensure a good quality of crimping.

SUMMARY OF THE INVENTION

To this end, the object of the present invention is a pair of crimping pliers, particularly for terminals on electric cables, comprising an upper arm bearing a fixed jaw with at least one indentation at its end, a lower arm, a hinge link that is interposed between said upper arm and said lower arm and that is articulated around the axes A1, A2, a movable jaw that has an indentation and is articulated, in relation to the upper arm, around an axis A3 and, in relation to the lower arm, around an axis A4, characterized in that the distance between the axes A1 and A2 is roughly equal to the distance between the axes A3 and A4 and in that the upper arm displays an angular point defining a body of the upper arm and a head of the upper arm, with the internal angle a, directed towards the lower arm, being less than 180°.

In accordance with another characteristic feature, the displacement circle of the axis A2 in relation to the axis A1, the displacement circle of the axis A4 in relation to the axis A2, and the displacement circle of the axis A4 in relation to the axis A3 have a roughly identical diameter.

Such a pair of pliers is particularly noteworthy in that the particular arrangement of the axes of articulation makes it possible largely to equilibrate the stresses at the level of the different axes, while producing a significant force at the level of the jaws and, at the same time, having a limited opening of the jaws.

In accordance with a characteristic arrangement, the angle $\alpha$ is 120°.

In accordance with another characteristic feature, the axis of articulation, A3, of the movable jaw is positioned perpendicular to the angular point.

Moreover, the axis A1 is positioned behind the axis A2 in relation to the jaws.

The pair of pliers is also characterized in that different angles have defined values:

- the angle $\beta$, defined by the segments [A4–A3] and [A4–M2], is less than 90°;
- the angle $\delta$, defined by the segments [A1–A3] and [A1–A2], is less than 90°; and
- the opening angle $\gamma$ of the upper arm (10) and lower arm (12) is less than 50°.

According to a refined variant, the fixed jaw comprises a turret, provided with indentations and mounted so as to rotate around an axis, and provided with a means of indexing the position of this turret.

BRIEF DESCRIPTION OF THE DRAWINGS

The present invention is now described in detail in regard to a preferred, non-limiting embodiment that is illustrated in the appended drawings, among which the different figures represent the following.

DETAILED DESCRIPTION

Figure 1:
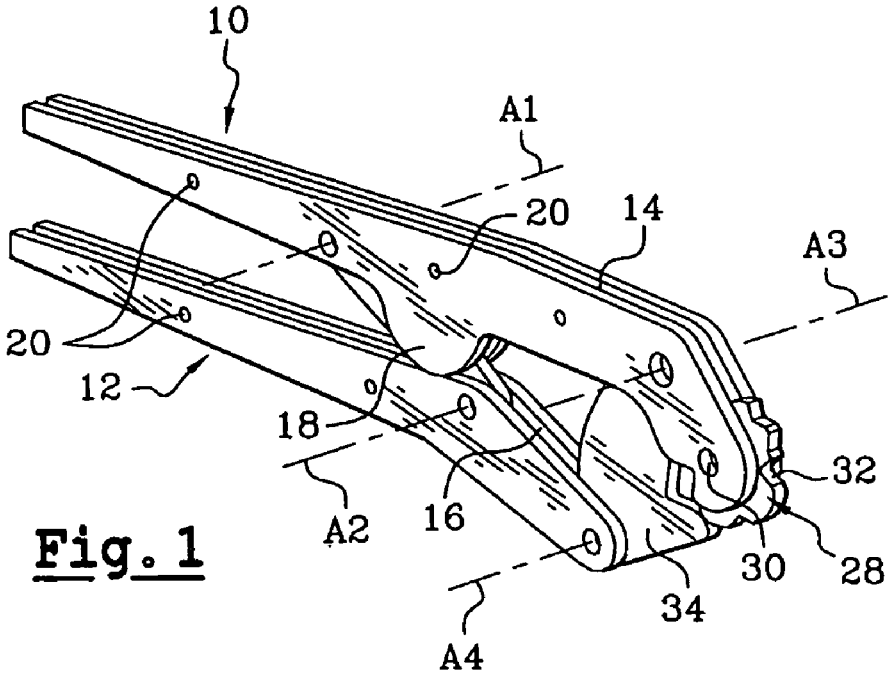
FIG. 1, a perspective view of a pair of crimping pliers in accordance with the present invention, in closed position.
Figure 2:
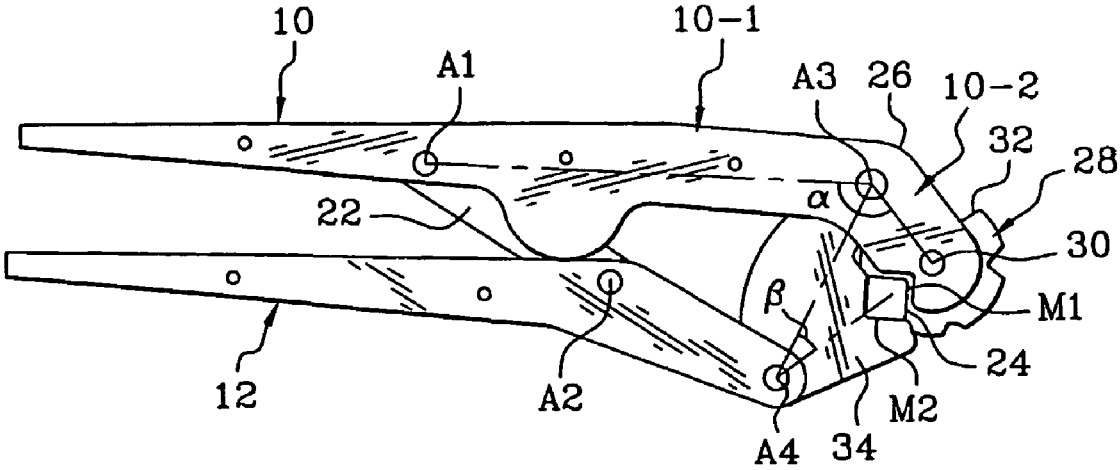
FIG. 2, a side view from above of this same pair of pliers.
Figure 3:
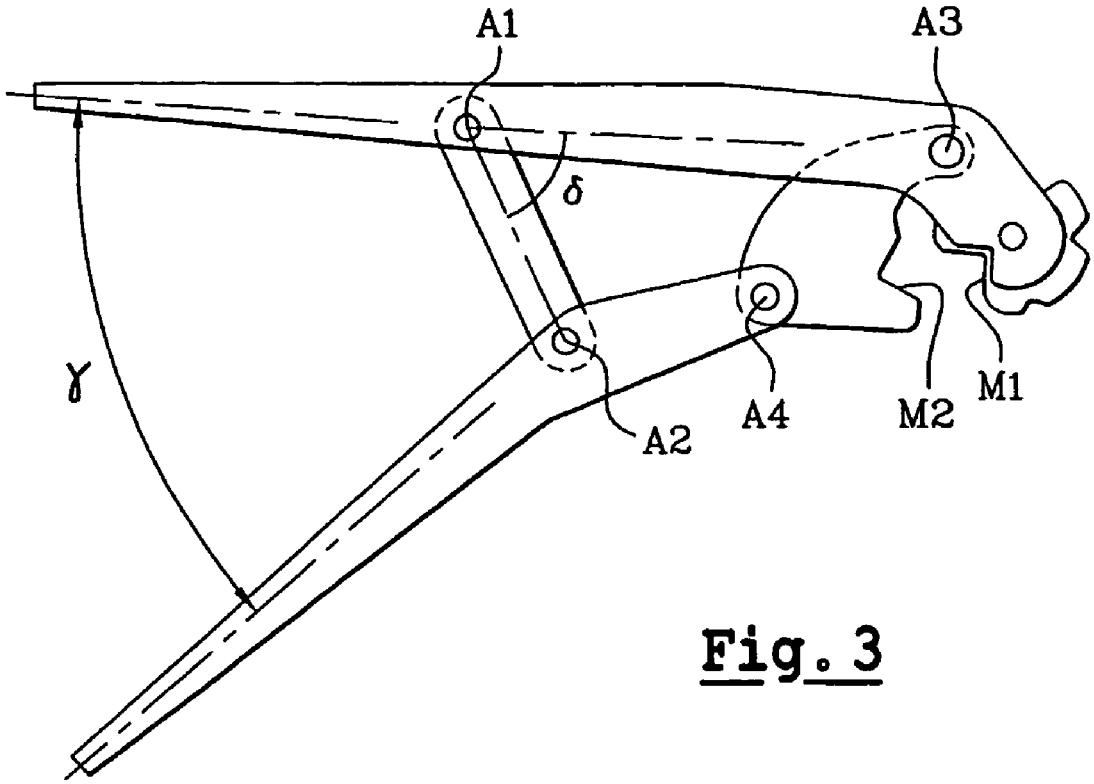
FIG. 3, a simplified and side view from above of the pair of pliers in accordance with the present invention, in open position.
Figure 4:
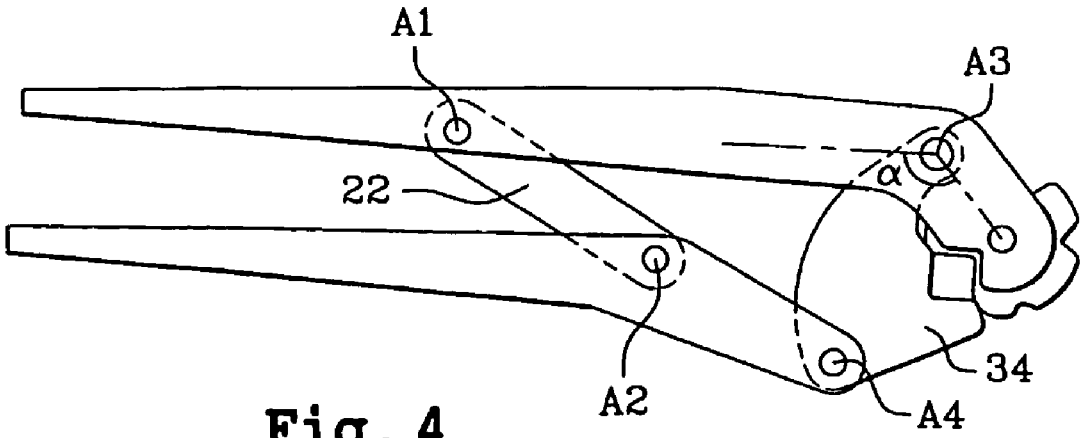
FIG. 4, a simplified and side view from above of the pair of pliers in accordance with the present invention, in closed position.

The pair of pliers in accordance with the present invention, represented in FIG. 1, comprises an upper arm 10 and a lower arm 12. Each arm is composed of two plates or is cast so as to leave a central gap 14 and 16 that permits the displacements of the different pieces.

The upper arm bears a safety catch 18 that engages between the two arms. In every case, this catch prevents contact of the arms perpendicular to the hand grip zone. Indeed, in the event that a piece breaks or there is a handling error, it serves to prevent any accidental pinching of the fingers of the operator.

In the case of a metallic realization, the plates are riveted and the rivets 20 appear in the figures.

A hinge link 22 is interposed between the arms 10 and 12. This hinge link is mounted in an articulated manner around the axis A1 in relation to the upper arm 10 and around the axis A2 in relation to the lower arm 12. The axis A1 is situated behind the axis A2 in relation to the jaws.

The upper arm 10 bears a fixed jaw 24 at its end with an indentation M1. This arm displays, in addition, an angular point 26 that defines a body 10-1 of the upper arm and a head 10-2 of the upper arm.

The internal angle $\underline{\alpha}$, directed towards the lower arm and defined by the body 10-1 and the head 10-2 of the upper arm, is less than 180°, preferably of the order of 120°.

In the preferred embodiment represented, the head 10-2 of the upper arm is equipped with a turret 28 that is mounted so as to rotate around an axis 30. This turret comprises several indentations 32 on its periphery and a means of indexing, which is not represented and makes it possible to maintain one, M1, of these indentations 32 in fixed position.

This is only a refinement of the pair of pliers in accordance with the invention; the upper arm 10 could bear, at its end, a single indentation that is fixed and of given profile, without changing the constitutive elements of the pair of pliers, providing a solution of the posed problems in the same way and affording the same advantages.

A movable jaw 34 is interposed between the upper and lower arms. This jaw is articulated around an axis A3 in relation to the upper arm 10 and around an axis A4 in relation to the lower arm 12. This jaw bears an indentation M2 at its end, which is intended to engage the indentation M1 when the pair of pliers is closed, as well be explained later.

The angle $\underline{\beta}$, defined by the segment [A4–A3] and [A4–M2], also has a given value, which is less than 90° C. As for the distances d[A1,A2] and d[A3,A4], they are roughly equal.

It can be seen in the arrangement presented that the axis of articulation, A1, is in back on the upper arm so as to increase the distance d[A1,A3]. Moreover, this makes it possible to extend the distance d[A1,A2] so as to make it roughly identical to the distance d[A3,A4], as was pointed out above. Thus, d[A1,A2]/d[A3,A4] is close to 1.

A third angle, the opening angle $\underline{\gamma}$, has to be kept at a maximum value, preferably a value less than 50°.

Figure 5A:
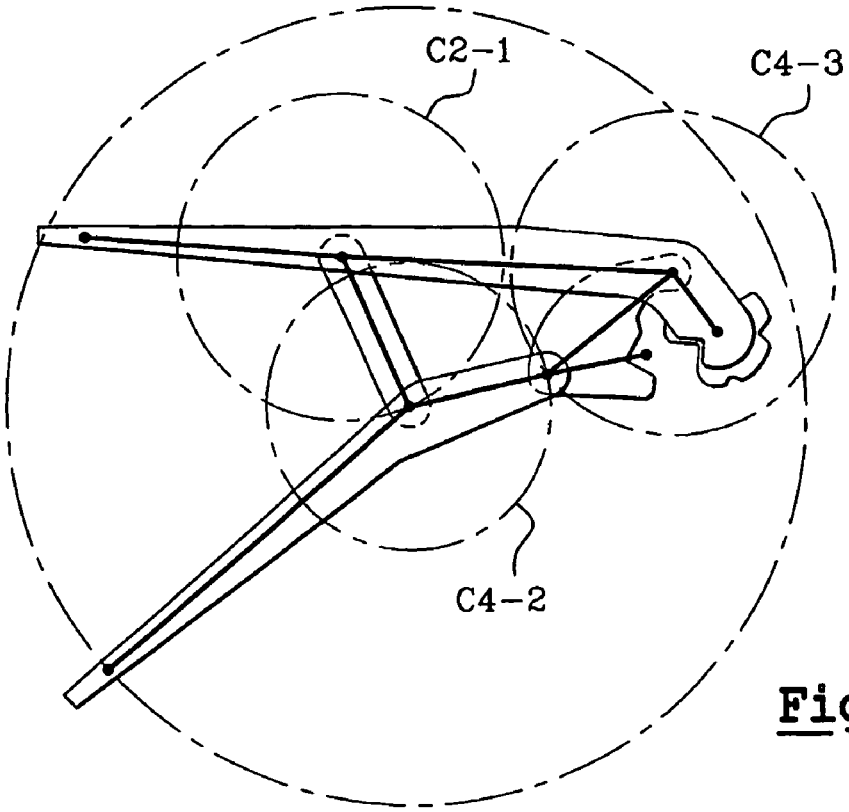
FIGS. 5A and 5B, views of the same pair of pliers in open and closed positions, showing the displacements following the circles of the principle points of articulation.
Figure 5B:
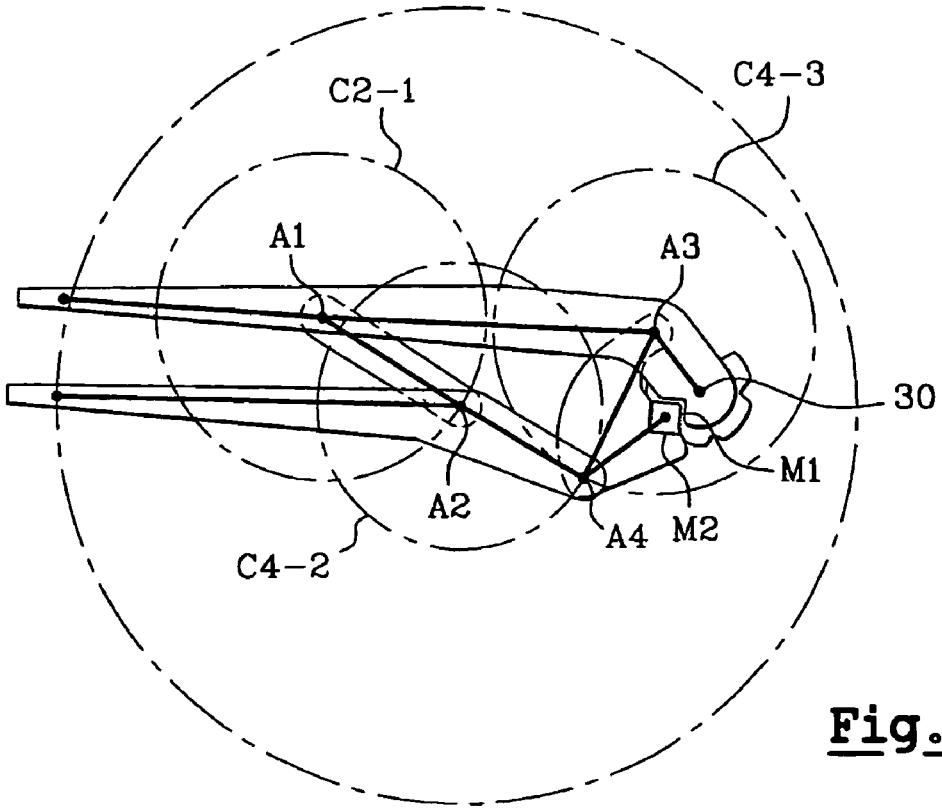

From FIGS. 5A and 5B, it is possible to compare the displacement circles of the different axes.

It is seen that the principle axes of the pair of pliers in accordance with the present invention move in relation to one another by following circles of roughly identical diameter. This translates into an equilibrated distribution of the stresses on each of the axes, because the arms of the lever required for the multiplication are of the same order of length.

The circle C2-1 corresponds to the displacement of the axis A2 in relation to the axis A1.

The circle C4-2 corresponds to the displacement of the axis A4 in relation to the axis A2.

The circle C4-3 corresponds to the displacement of the axis A4 in relation to the axis A3.

It is also seen that moving the axis A1 toward the back, in relation to the arrangements of prior art, makes it also possible to lengthen the distance covered by the arc of the circle described by the axes A2 and A4 in relation to the axis A1 and A3.

The force exerted by the movable jaw on the fixed jaw is directed from M2 toward M1 or toward the axis 30 of the turret when one is provided for.

The axis A2 is positioned at the vertex of an arch of stress recovery defined by the two segments [A1–A3] and [A3–(30)] or [A3–M1], depending on the arrangement. This reinforces the strength at this point.

During all the movement of opening and especially of closing the pair of pliers, the angle $\underline{\delta}$ stays at values less than 90°.

The pair of pliers realized in this way offers a certain ergonomics, which is due largely to the reduced degree of opening of the arms as well as to the equilibrated stresses on the different axes, which thereby increases the longevity of this pair of pliers.

Such a pair of pliers can be made of composite materials without fearing points of fragility produced by very significant localized stresses.

The invention claimed is:

1. A pair of crimping pliers comprising an upper arm (10) bearing a fixed jaw with at least one indentation (M1) at its end, a lower arm (12), a hinge link (22) that is interposed between said upper arm and said lower arm and that is articulated around the axes A1 and A2, a movable jaw (34) that has an indentation (M2) cooperable with said one indentation (M1) for crimping a workpiece and is articulated, in relation to the upper arm, around an axis A3 and, in relation to the lower arm, around an axis A4, characterized in that the distance between the axes A1 and A2 is roughly equal to the distance between the axes A3 and A4 and wherein said indentation (M2) on said movable jaw is rotatable relative to said axis A3 and maintained at a fixed distance from said axis A3.

2. The pair of crimping pliers in accordance with claim 1, further characterized in that the displacement of the axis A4 corresponds to a circle (C4-2) centered with respect to the axis A2.

3. The pair of crimping pliers in accordance with claim 1, further characterized in that the axis A1 is positioned behind the axis A2 in relation to the jaws.

4. The pair of crimping pliers in accordance with claim 1, further characterized in that the displacement circle (C2-1) of the axis A2 in relation to the axis A1, the displacement circle (C4-2) of the axis A4 in relation to the axis A2, and the displacement circle (C4-3) of the axis A4 in relation to the axis A3 have a roughly identical diameter.

5. The pair of crimping pliers in accordance with claim 1, further characterized in that an angle β, defined by a segment joining the axis A4 and A3 and by a segment joining the axis A4 and the indentation M2, is less than 90°.

6. The pair of crimping pliers in accordance with claim 1, further characterized in that an angle δ, defined by a segment joining the axis A1 and A3 and by a segment joining the axes A1 and A2 is less than 90°.

7. The pair of crimping pliers in accordance with claim 1, further characterized in that an opening angle γ, defined by the upper (10) and lower (12) arms, is less than 50°.

8. The pair of crimping pliers in accordance with claim 1, further characterized in that the fixed jaw (24) comprises a turret (28), provided with indentations (32) and mounted so as to rotate around an axis (30), and provided with a means of indexing the position of the turret.

9. The pair of crimping pliers in accordance with claim 1, characterized in that it is made of composite materials.

10. The pair of crimping pliers in accordance with claim 8 wherein an angle α, defined by a segment joining the axes A1 and A3 and by a segment joining the axis A3 and the rotation axis (30) of the turret (28), is less than 180°.

11. A pair of terminal crimping pliers comprising:

an upper arm comprising a fixed jaw with at least one indentation at its end;

a lower arm;

a hinge link that is interposed between the upper arm and the lower arm, wherein the hinge is articulated around a first axis on the upper arm and a second axis on the lower arm;

a movable jaw that has an indentation cooperable with said one indentation for crimping a terminal, wherein the movable jaw is articulated around a third axis on the upper arm and around a fourth axis on the lower arm wherein the indentation of the movable jaw is rotatable relative to the third axis and maintained at a fixed distance from said third axis, and wherein a first distance between the first and second axes is substantially equal to a second distance between the third and fourth axes.

12. The pair of terminal crimping pliers in accordance with claim 11, further characterized in that a displacement of the fourth axis corresponds to a circle centered with respect to the second axis.

13. The pair of terminal crimping pliers in accordance with claim 11, further characterized in that the first axis is positioned behind the second axis in relation to the jaws.

14. The pair of terminal crimping pliers in accordance with claim 11, further characterized in that a first displacement circle of the second axis in relation to the first axis, a second displacement circle of the fourth axis in relation to the second axis, and a third displacement circle of the fourth axis in relation to the third axis have substantially a same diameter.

15. The pair of terminal crimping pliers in accordance with claim 11, further characterized in that an angle β, defined by a segment joining the fourth axis and the third axis and by a segment joining the fourth axis and the indentation, is less than 90°.

16. The pair of terminal crimping pliers in accordance with claim 11, further characterized in that an angle δ, defined by a segment joining the first axis and the third axis and by a segment joining the first axes and the second axis, is less than 90°.

17. The pair of terminal crimping pliers in accordance with claim 11, further characterized in that an opening angle γ, defined by the upper and lower arms, is less than 50°.

18. The pair of terminal crimping pliers in accordance with claim 11, further characterized in that the fixed jaw comprises a turret provided with indentations and mounted so as to rotate around an fifth axis, and provided with an indexing system for indexing positioning of the turret relative to the upper arm.

19. The pair of terminal crimping pliers in accordance with claim 18 wherein an angle α, defined by a segment joining the first and second axes and by a segment joining the third axis and the fifth axis of the turret, is less than 180°.

* * * * *